US010675502B2

(12) United States Patent
Hallmark

(10) Patent No.: US 10,675,502 B2
(45) Date of Patent: Jun. 9, 2020

(54) MULTI-FUNCTIONAL EXERCISE DEVICE

(71) Applicant: TAMH ENTERPRISES, LTD., Marble Falls, TX (US)

(72) Inventor: Timothy Hallmark, Marble Falls, TX (US)

(73) Assignee: TAMH Enterprises, Ltd., Marble Falls, TX (US)

( * ) Notice: Subject to any disclaimer, the term of this patent is extended or adjusted under 35 U.S.C. 154(b) by 10 days.

(21) Appl. No.: 16/086,945

(22) PCT Filed: Mar. 23, 2017

(86) PCT No.: PCT/US2017/023729
§ 371 (c)(1),
(2) Date: Sep. 20, 2018

(87) PCT Pub. No.: WO2017/165596
PCT Pub. Date: Sep. 28, 2017

(65) Prior Publication Data

US 2019/0105527 A1 Apr. 11, 2019

Related U.S. Application Data

(60) Provisional application No. 62/312,432, filed on Mar. 23, 2016.

(51) Int. Cl.
*A63B 21/00* (2006.01)
*A63B 21/068* (2006.01)
(Continued)

(52) U.S. Cl.
CPC ..... *A63B 21/4029* (2015.10); *A63B 21/0442* (2013.01); *A63B 21/0552* (2013.01);
(Continued)

(58) Field of Classification Search
CPC ..... A63B 21/0552; A63B 21/0442; A63B 21/0622; A63B 21/0726; A63B 21/068; A63B 21/4034; A63B 21/4035; A63B 21/4043; A63B 21/4039; A63B 21/158; A63B 21/4029; A63B 23/1209; A63B 23/1236; A63B 23/1227; A63B 23/1218;
(Continued)

(56) References Cited

U.S. PATENT DOCUMENTS 4,861,024 A * 8/1989 Lee ..... A63B 23/00 482/104
5,518,487 A * 5/1996 Hallmark ..... A63B 23/0211 482/140
(Continued)

FOREIGN PATENT DOCUMENTS

CN 2493240 5/2002

OTHER PUBLICATIONS

International Search Report and Written Opinion of related PCT/US2017/023729, dated Sep. 23, 2017.

*Primary Examiner* — Megan Anderson
(74) *Attorney, Agent, or Firm* — Boulware & Valoir

(57) ABSTRACT

A multifunctional exercise device is described. The multifunctional exercise device has multiple configurations where the user can perform different exercises by simply adjusting the angle of the bench to utilize both the user's bodyweight and gravity as the resistance.

11 Claims, 10 Drawing Sheets

(51) Int. Cl.

| | |
|---|---|
| ***A63B 21/04*** | (2006.01) |
| ***A63B 21/055*** | (2006.01) |
| ***A63B 21/072*** | (2006.01) |
| ***A63B 23/02*** | (2006.01) |
| ***A63B 23/12*** | (2006.01) |
| ***A63B 21/062*** | (2006.01) |
| *A63B 71/00* | (2006.01) |

(52) U.S. Cl.

CPC ..... *A63B 21/068* (2013.01); *A63B 21/0622* (2015.10); *A63B 21/0726* (2013.01); *A63B 21/4034* (2015.10); *A63B 21/4035* (2015.10); *A63B 23/0211* (2013.01); *A63B 23/0216* (2013.01); *A63B 23/1209* (2013.01); *A63B 23/1218* (2013.01); *A63B 23/1227* (2013.01); *A63B 23/1236* (2013.01); *A63B 21/158* (2013.01); *A63B 21/4039* (2015.10); *A63B 21/4043* (2015.10); *A63B 23/1281* (2013.01); *A63B 2071/0072* (2013.01); *A63B 2208/0228* (2013.01); *A63B 2208/0252* (2013.01); *A63B 2225/09* (2013.01); *A63B 2225/093* (2013.01)

(58) Field of Classification Search

CPC ..... A63B 23/0216; A63B 23/0211; A63B 23/1281; A63B 2071/0072; A63B 2208/0228; A63B 2208/0252; A63B 2225/09; A63B 2225/093

See application file for complete search history.

(56) References Cited

U.S. PATENT DOCUMENTS

| | | | | |
|---|---|---|---|---|
| 5,527,249 | A | 6/1996 | Harris | |
| 6,206,809 | B1 * | 3/2001 | Habing | A63B 23/0211 482/140 |
| 6,641,509 | B1 | 11/2003 | Chen | |
| 7,674,215 | B1 | 3/2010 | Swanson | |
| 9,072,937 | B2 * | 7/2015 | Katz | A63B 21/068 |
| 2002/0111258 | A1 | 8/2002 | Slattery | |
| 2007/0087915 | A1 * | 4/2007 | Carattoni | A63B 21/068 482/95 |
| 2012/0277076 | A1 | 11/2012 | Huang | |
| 2018/0099176 | A1 * | 4/2018 | Specht | A63B 21/4029 |

* cited by examiner

MULTI-FUNCTIONAL EXERCISE DEVICE

PRIOR RELATED APPLICATIONS

This application is a National Phase filing under 35 U.S.C. § 371 of International Application PCT/US2017/023729, filed on Mar. 23, 2017, which claims priority to 62/312,432, filed Mar. 23, 2016. Both applications are expressly incorporated by herein by reference in their entirety for all purposes.

FIELD OF THE DISCLOSURE

The present invention relates to the field of exercise equipment, and particularly to an apparatus that accommodates abdominal, oblique, lower back, arms, latissimus dorsi, inversion training exercises, and resistance training exercises, all using the same apparatus.

BACKGROUND OF THE DISCLOSURE

There are many devices designed for exercising different parts of the body. For example, U.S. Pat. No. 6,641,509 describes a multifunctional exercise device that allow an user to work out trapesium, deltoid, and latissimus dorsi, and in a different setting that works out also triceps, biceps, pectoralis major, etc. However, these exercise devices are not easy to use, the footprint and size of the device are large, not easy to switch between different modes during a workout, and the muscles trained are not targeted or focused enough for efficient muscle building during the workout and training.

These exercises would normally require at least five devices to accomplish the same results, as opposed to only one device in the present invention.

SUMMARY OF THE DISCLOSURE

The exercise device of this disclosure for performing abdominal, oblique, lower back, arms, latissimus dorsi, inversion training exercises and resistance training exercises is comprised of a base frame with two c-shaped legs that angle out from the center of the base frame to the corners for ultimate stability. A bench frame is pivotally attached to a support extending from the base frame. The bench frame supports the bench that can be adjusted from the horizontal position, zero degrees, up to thirty degrees above horizontal. The bench has two adjustable hand grips on either side of the bench for the user to hold or grip with their hands while performing various exercises. There are two upper torso support pads that position the users' arms on each side of the bench. The hand grips fold down away from the user while performing various exercises.

Therefore, the primary objective of this disclosure is to provide a multifunctional exercise device with minimal footprint, easily adjustable to different configurations for training different muscles and a stable device for the user.

In one aspect of this disclosure, it is provided a multifunctional exercise device, comprising: a base frame having a plurality of legs extending horizontally along a longitudinal axis, a curved support extending upwardly from the base frame, and an adjustable arm with a telescoping means extending upward from the middle of the base frame; a bench frame having a head end and a foot end, wherein the curved support connects to the foot end and the and the adjustable arm pivotally connects to the middle of the bench frame adjustably whereby the telescoping means adjusts the angle of the upper bench from horizontal to about 30 degrees above horizontal; a bench pad overlaying the bench frame; hand grips pivotally connected to either side of the middle of the bench frame, wherein the hand grips have two configurations relative to the bench frame movable and secured by a switching mechanism, wherein in one of said configurations the hand grips are above the bench frame, and in the other of said configurations the hand grips are below the bench frame; an elbow pad overlaying each said hand grip spaced below the grip for the hands to contact the user's elbows; and a detachable foot grip module pivotally connected to the head end of the bench frame, the foot grip module switchable between a plurality of angles and locked by a switching mechanism.

In one embodiment, the end of each of the legs of the base frame has a foot pad contacting the floor surface.

In one embodiment, the telescoping angle-adjusting means comprising a smaller tube inside a larger tube, the smaller tube having a plurality of through holes spaced along its length, and wherein the overall length of the angle-adjusting means is adjusted and maintained through a lock pin located on the larger tube that engages one of said through holes on the smaller tube.

In one embodiment, the device further comprises a dashpot alongside the telescoping angle-adjusting means.

In one embodiment, each of the hand grips can rotate along the horizontal plane so that the user's head can rest on either the head end or the foot end of the upper frame while holding the handle.

In one embodiment, each of the legs has at least one band peg.

In one embodiment, the base further comprises a safety rod extending vertically to prevent the head end of the upper frame from lowering below foot end thereof.

In one embodiment, each of the hand grips is pivotally connected to an adaptor plate under the middle of the bench frame, the adaptor plate having a plurality of through holes, and each of the hand grips further comprising a snap-back locking pin corresponding to one of the through holes on the adaptor plate to lock the hand grips at one of the plurality of configurations.

In one embodiment, the foot grip module is pivotally connected to an adjustment plate under the head end of the bench frame, the adjustment plate having a plurality of through holes, and the foot grip module further comprising a snap-back locking pin corresponding to one of the through holes on the adjustment plate to lock the foot grip module at one of the plurality of configurations.

The disclosed exercise device is the only bench that allows users to perform ten core exercises, body weight exercises, dumbbell exercises, band resistant exercises, inversion exercises (i.e. spine decompression when the user is in an upside-down position) all on the same bench totaling about 40 exercises. Conventionally it would take at least 5 different exercise apparatuses to perform most of these exercises, and the combination of these apparatuses would be a much more substantial capital investment and would take up too much space. Therefore, the disclosed exercise device realizes the need for a compact, versatile, durable, stable and inexpensive exercise device for all levels of users.

The use of the word "a" or "an" when used in conjunction with the term "comprising" in the claims or the specification means one or more than one, unless the context dictates otherwise.

The term "about" means the stated value plus or minus the margin of error of measurement or plus or minus 10% if no method of measurement is indicated.

The use of the term "or" in the claims is used to mean "and/or" unless explicitly indicated to refer to alternatives only or if the alternatives are mutually exclusive.

The terms "comprise", "have", "include" and "contain" (and their variants) are open-ended linking verbs and allow the addition of other elements when used in a claim.

The phrase "consisting of" is closed, and excludes all additional elements.

The phrase "consisting essentially of" excludes additional material elements, but allows the inclusions of non-material elements that do not substantially change the nature of the invention.

DETAILED DESCRIPTION

The exercise device generally comprises the following parts: the base frame, the upper frame (the bench), the adjustable grips, and the foot grip module, each of which will be discussed in detail with reference to FIGS. 1 and 2.

Figure 1:
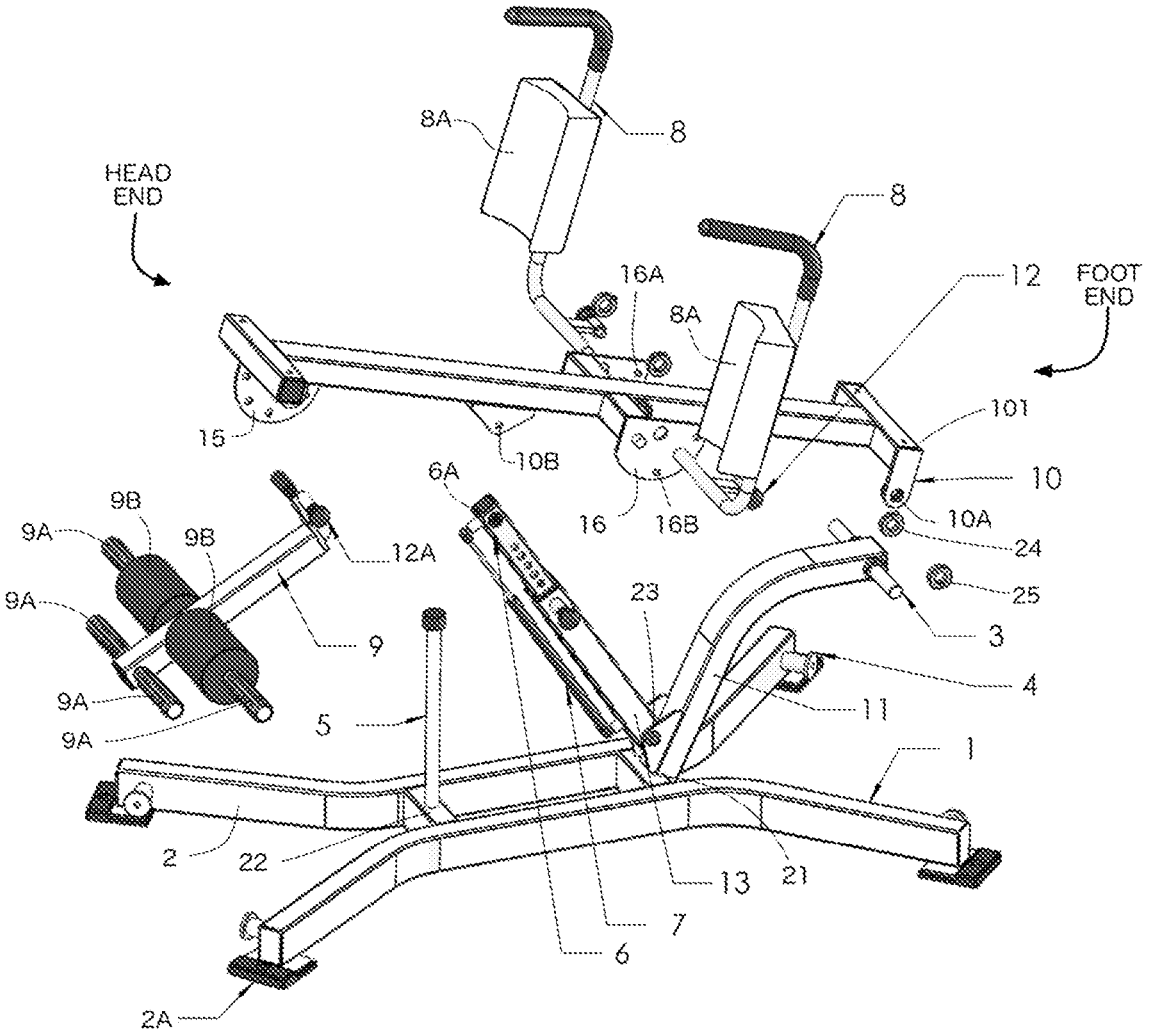
FIG. 1. A perspective view of the exercise device of this application.

THE BASE Referring to FIG. 1, the base frame 1 of the exercise device is comprised of welded rectangular and square steel tubing, but other materials that may be lighter, stronger or more economically efficient can be used. Each of the two c-shaped legs 2 extending from the base frame have two feet and each foot has a flat foot pad 2A that also ensure stability by friction and gravity forces while a person is performing various exercises. Between the two c-shaped legs 2 on the base frame 1 that rests on the floor are cross members 21 and 22 between the legs. Alternatively the base could be solid with legs extending from the center. At least one band peg 4 is welded onto the inside of at least the end of one leg to provide various resistance training exercises, for example elastic ropes can be circling around either of the band peg 4 and back to the user for easier training on the arms, legs or other intended muscles. Mounted to cross member 22 of the base frame is a solid steel safety rod 5 extending upward engaging the underside of the bench fame 10. The safety rod 5 prevents the bench frame 10 from collapsing while in the horizontal position or other position under the weight of the user and prevents the possibility of injury to the user.

The base frame has a curved support 11 that is attached to cross member 21 and extends from the base frame and curves toward the foot end of the bench frame. The adjustable base frame 1 also connects to the bench frame 10 with an adjustable arm 13 extending from base point 23 about midway on the base frame 1, where the adjustable arm 13 has a telescoping assembly 6 that can be raised or lowered for different exercises. The adjustable arm 13 is used to maintain the position and angle of the bench frame 10 in a stable manner. Extending from base point 23 on the top of the base frame mounted on cross member 21 is the adjustable arm 13, with the telescoping assembly 6 having a smaller tube that telescopes inside a larger tube. The top end 6A of the telescoping assembly 6, opposite to the base point 23, is mounted to the bench frame 10 at joint point 10B. For illustration purpose the assembly is shown in exploded view in FIG. 1, but in a fully assembled unit the base frame and bench frame are securely connected at 10B. The connection between the telescoping assembly 6 and the bench frame 10 is preferably not easily detached due to the potential hazard that may be caused by the dislocation of the heavy bench frame during use. In this embodiment the joint point 10B is a bolted attachment.

In a preferred embodiment, the telescoping assembly 6 has at least nine holes spaced along the length of the telescoping arm and into which a locking pin (not shown) snaps so as to determine the height and angle of the upper frame at desired intervals. An additional mechanical spring, hydraulic or pneumatic dashpot 7 can also be provided alongside the adjustable arm 13. A dashpot is a mechanical device, a damper which resists motion via viscous friction. The resulting force is proportional to the velocity, but acts in the opposite direction, slowing the motion and absorbing energy. The dashpot therefore prevents any sudden loss of position of the adjustable arm 13 that may injure the user while adjusting the bench frame 10.

BENCH FRAME As discussed above, the bench frame 10 is pivotally attached to the curved support 11 of the base frame 1. In a preferred embodiment, as discussed above, a support extends from the foot end of the bench frame terminates in a U-shape 101 with short arms extending downward on either side of the foot that each have openings 10A sized to receive a metal rod 3 therethrough that is held into place with bolts 24 and 25, as shown in FIG. 3, securely in the openings for stability and durability. The rod 3 and bolts are show before the rod is inserted into the holed and securely bolted. The bench frame 10 includes an upper frame pad 14, as shown in FIG. 2, that is substantially the size of the bench frame that provides cushion for a user lying on it, two elbow pads 8A for additional cushion when the user puts body weight on them, adjustable foot grip module 9 pivotally attached to an adjustment plate 15 underneath the head end of the bench 10. The adjustment plate 15 has multiple holes designed to receive the snap-back locking pull pins 12A to maintain the position of the foot grip module. Depending on the user's need, the bench frame 10 can be adjusted from zero degree (horizontal to the base frame), measuring at both ends of the bench frame 10, to the head end being thirty degrees above horizontal, with each hole on the smaller tube 6 providing about a 5-degree increment incline.

The wide range of adjustability allows users of different level, from the elite athlete, beginner to a patient, to get positive results all on the same apparatus. The seven different adjustment levels, each adjusted at about five degrees, also creates more resistance without the use of anything but the users' own body weight and gravity. The higher angles of the upper frame will provide more difficult resistance to the exercise. Of course, the angled upper frame coupled with using weights or other accessories can also enhance the training results.

Figure 2:
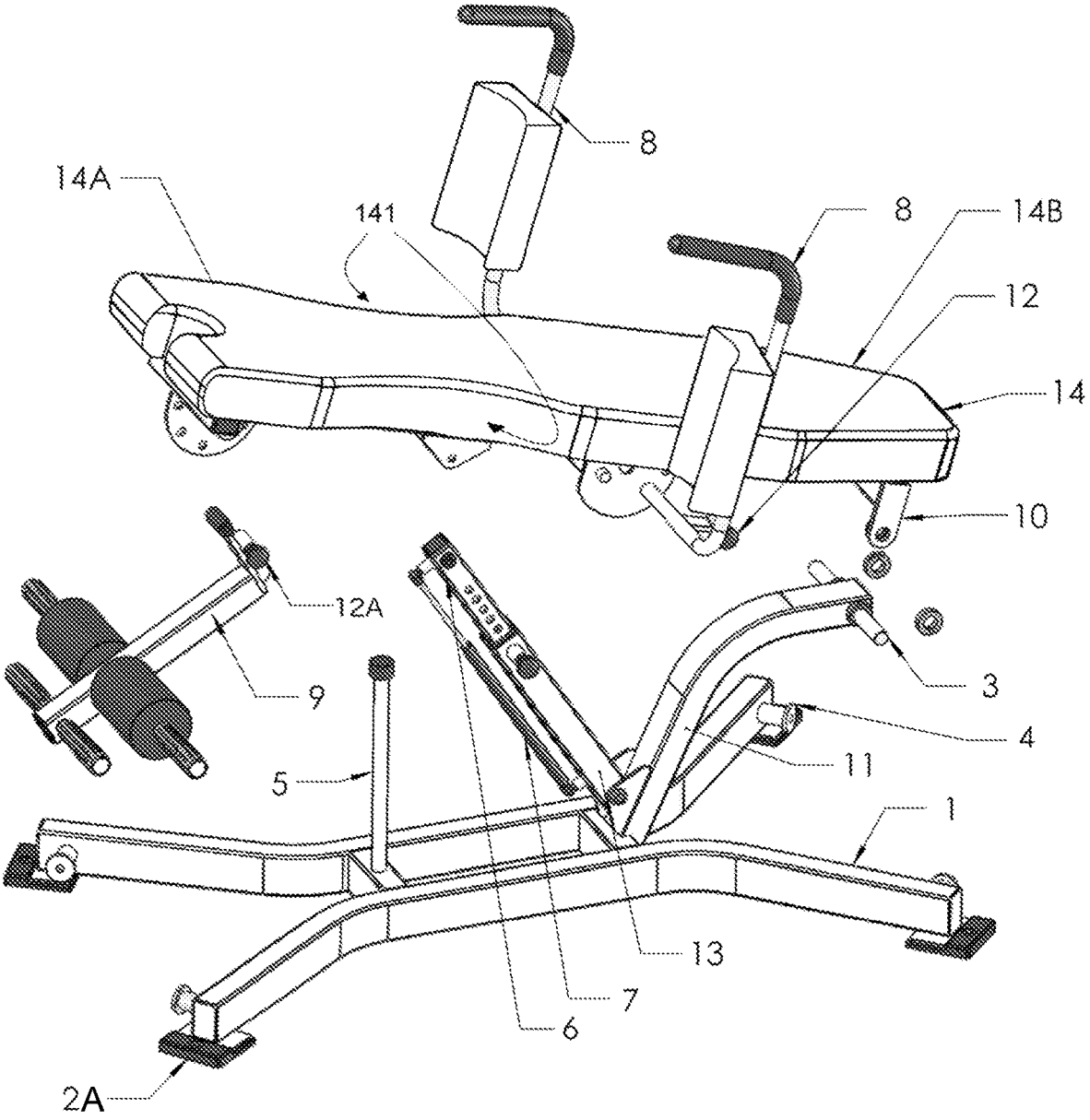
FIG. 2. A perspective view of the exercise device with a bench pad covering the bench frame.
Figure 3:
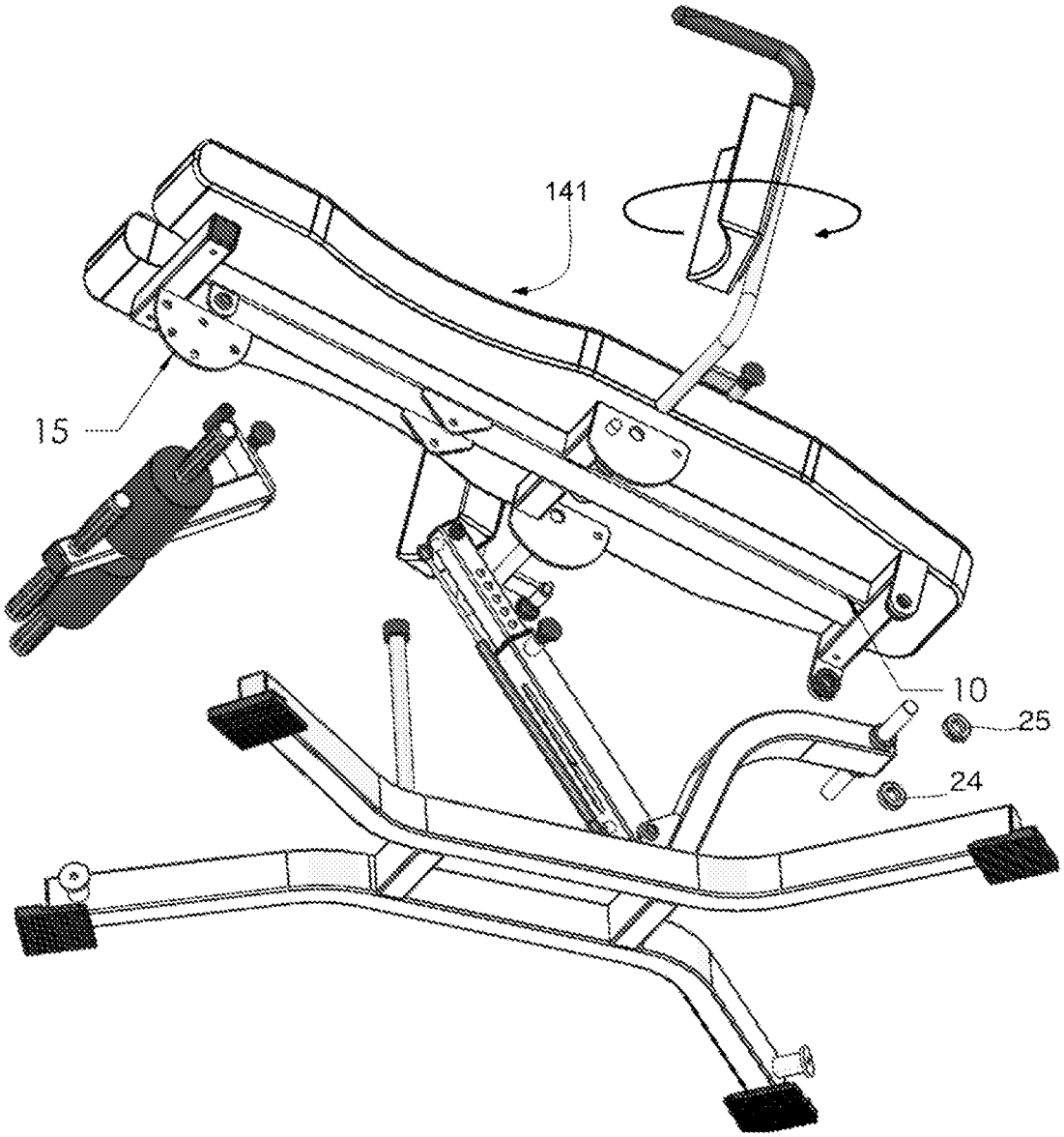
FIG. 3. A bottom view of the exercise of this application.

BENCH PAD As shown in FIG. 2, there is an hour glass shaped upholstered pad 14 with a head end 14A and a foot end 14B. The head end 14A of the bench has a cut out allowing male users to perform reverse lower back extensions comfortably. Extra padding has been added for comfort in performing these types of exercises. The coved areas on each side of the pad allow the arms to adjust comfortably while using the elbow pads 8A. The foot end 14B of the pad is tapered to provide elbow clearance while performing various resistance exercises. There are also cutouts 141 near the head end 14A to allow a user performing various dumbbell raise without hindrance as compared to bench pad not having the cutouts 141.

ADJUSTABLE HAND GRIPS The adjustable hand grips 8 extend from the near the middle of the bench frame 10 so that the user can naturally grab a grip 8 with each hand on each side of the bench. The hand grips 8 extend from two plates 16 mounted underneath the middle section of the bench frame 10. The two upper torso support pads, or elbow pads 8A mounted on the adjustable hand grips 8, that position the users' arms on each side of the bench. The position of the hand grips 8 are determined and secured in place by a snap-back locking pull pin 12 that engages the holes 16A on the adaptor plate 16. The position of holes 16A on the adaptor plates 16 are designed so that the user can rotate the hand grips between a "use" position above the bench and a "store" position below the bench frame. The adjustable hand grips can therefore rotate 180 degrees to a position completely below the bench by pulling the snap-back locking pull pin 12 away from the holes 16A, and will stay in place below the bench by releasing the snap-back locking pull pin 12 back into the holes 16B. Such mechanism ensures the bench in a secured position. Additionally, the ability to rotate the hand grips below the bench when not needed allows the user to perform other exercises that would otherwise be hindered with the handle section in the upright position. Also, when stored in the "store" position there is a larger surface area for the user to utilize when lying on the bench.

In an embodiment, the handle can rotate 180 degree along the horizontal plane, as shown in FIG. 3, so that the user can naturally hold the handle when orienting her head on either the head end or foot end of the bench. This is preferable because for advanced users who wishes to maximize the gravitational resistance in an upside-down position, the rotatable handles provide the possibility.

Adjustable Handle and Foot Grip Module The head end of the bench 14A has an adjustable grip module 9, including two sets of handles 9A by which the user can hold on with the hands while performing various exercises, such as lifting legs when lying on the bench with both hands holding the handles 9A. The grip module 9 further includes foot pads 9B that can be used to secure the user's feet for other exercises and to perform inversion training. The module 9 is a rod with the two sets of handles extending outward from the rod. Module 9 is detachably mounted to the head of the bench frame 10 on adjustment plate 15 that is mounted under the bench frame. The adjustable grip module 9 can be kept in the upright position by a locking pull pin 12A that engages holes spaced in the adjustment plate. The foot grip module 9 can pivot down underneath the head end of the bench using three adjustments holes provides by the adjustment plate 15 when releasing the locking pull pin 12. Pivoting the grip module down beneath the head end of the bench allows the user to do reverse low back extensions, latissimus dorsi and arm exercises that cannot be done with the grip module in an upright position. Other intermediate angles allow variable resistance depending on the user's need.

FIG. 2 provides a bottom view of the exercise device that better illustrates the interconnection between the upper frame and the base, between the handle section and the upper frame, and between the foot grip module and the upper frame.

The exercise device of this disclosure is easy to use, easy to switch between different configurations while maximizing the stability and durability.

Figure 4A:
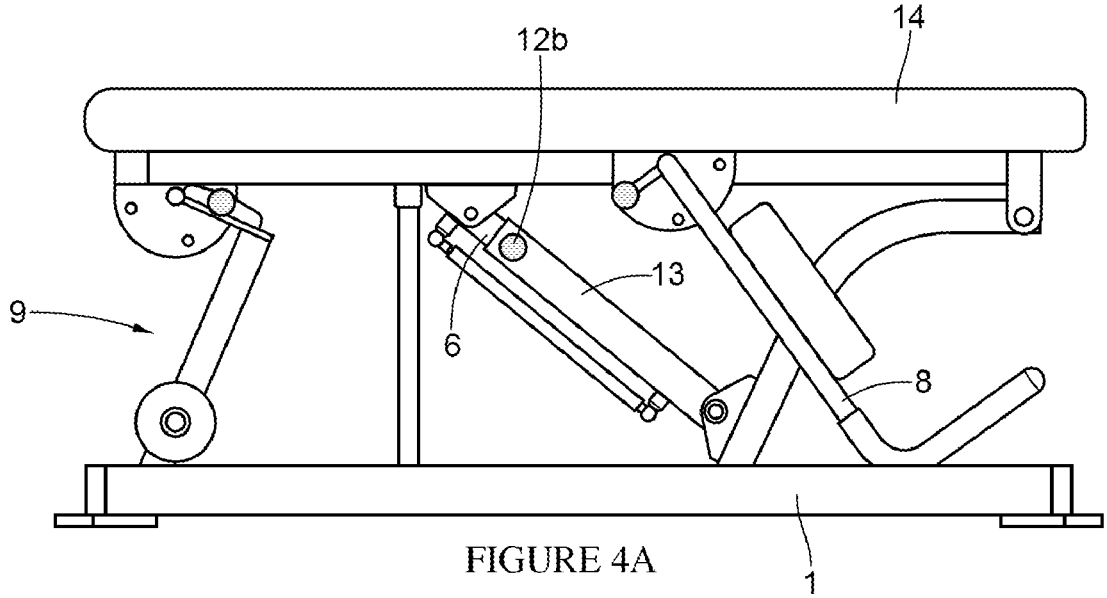
FIG. 4A: a side view showing the multifunctional exercise device of this disclosure, where both the foot grip module and the hand grips are rolled down, and the telescoping means retracted.

FIG. 4A is a side view of the multifunctional exercise device of this disclosure, where both the foot grip module 9 and the hand grip 8 are rotated beneath the bench 14, and the telescoping assembly 6 is completely retracted to keep the bench 14 at horizontal. A user can use the exercise device as a regular bench.

Figure 4B:
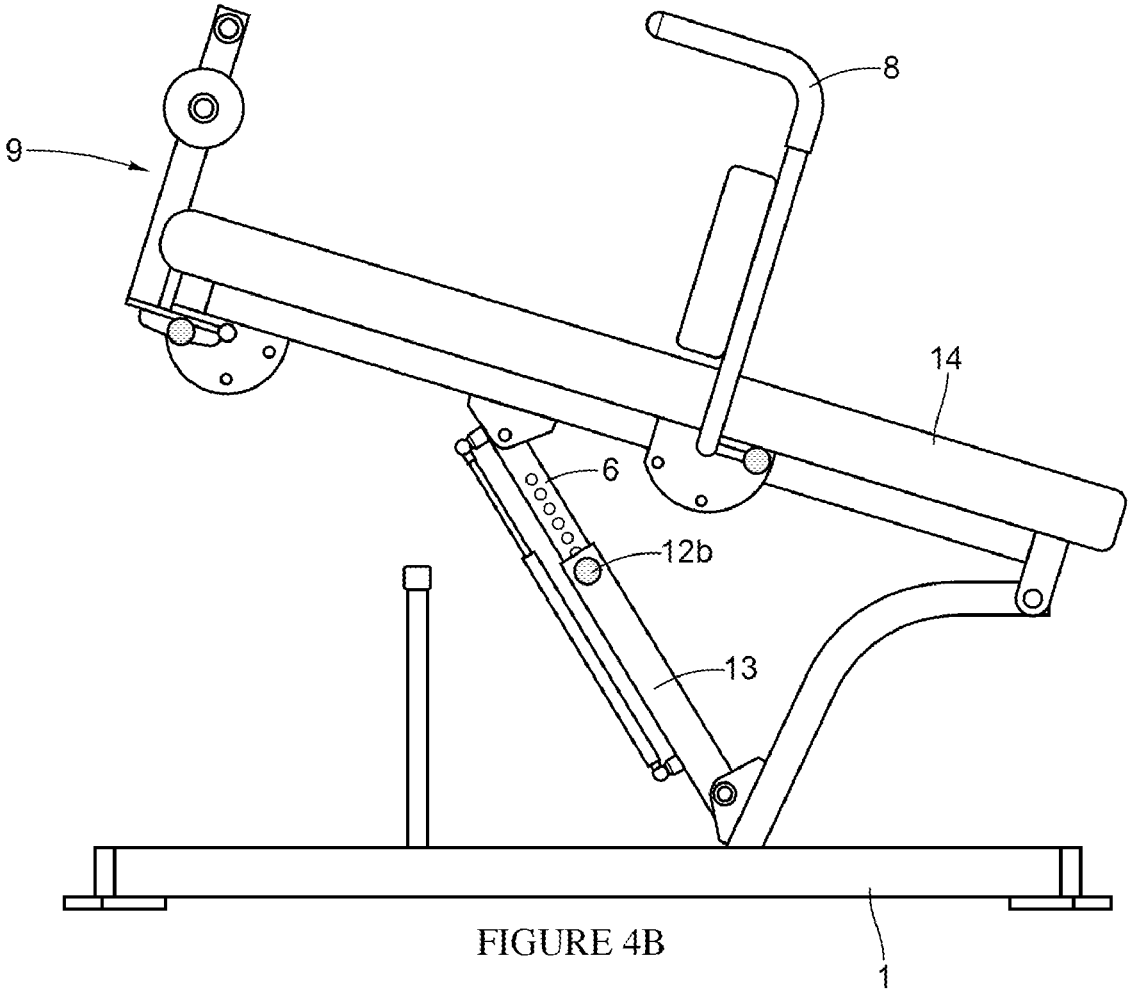
FIG. 4B: a perspective view showing the multifunctional exercise device of this disclosure, where both the foot grip module and the hand grips are rolled up, and the telescoping means extended to the fullest extent.

FIG. 4B is a side view of the multifunctional exercise device of this disclosure, where both the foot grip module 9 and the hand grip 8 are rotated above the bench 14, and the telescoping assembly 6 is fully extended to lift the bench 14. Changing the configurations between FIGS. 4A and 4B is easy by the pull-pin locking mechanisms provided for the foot grip module, the hand grip and the telescoping assembly.

Below a detailed discussion regarding how to operate the exercise device of this disclosure is provided to better illustrate the operations of the multi-functional exercise device.

Figure 5A:
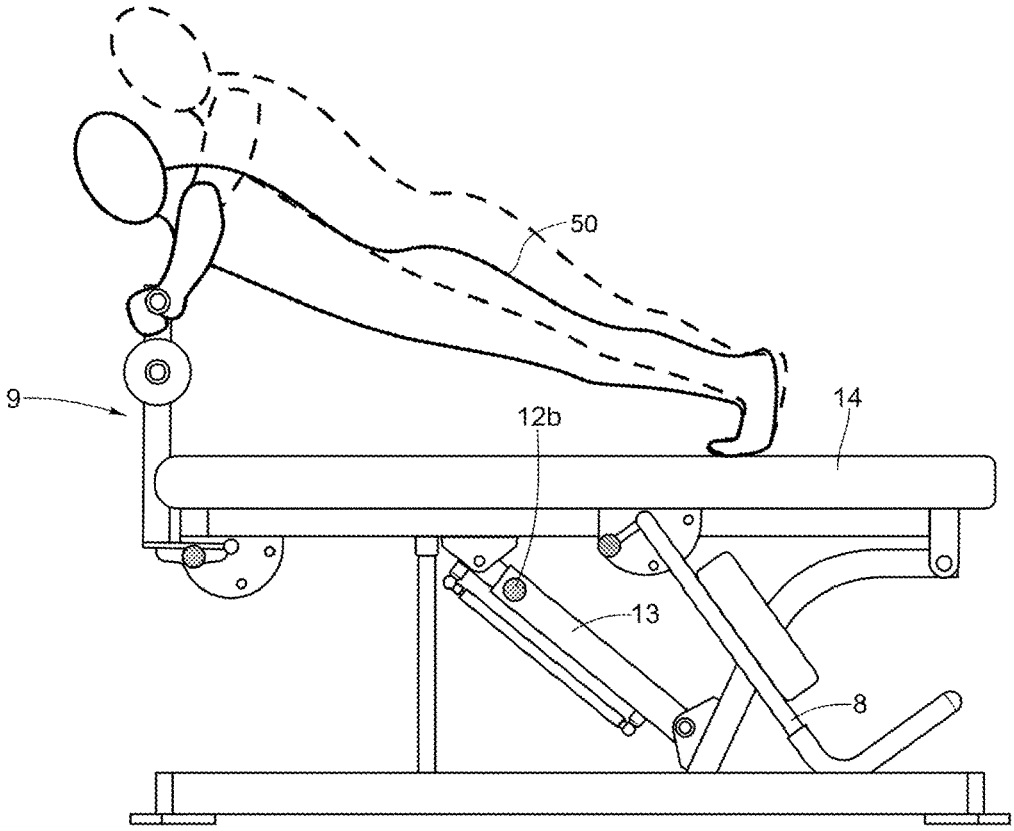
FIG. 5A. A side view of a user using the exercise device of this disclosure to perform a push-up exercise.

FIG. 5A is a side view of a user using the multi-functional exercise device of this disclosure for push-up training. In this configuration the bench 14 level, while the adjustable foot grip module 9 is configured to the upright position. The user 50 holds the handle 9A on the foot grip module 9 and places her foot at the foot end 14*b* of the bench 14. The user can easily adjust the inclination of the bench 50 to reduce the difficulty of push-up exercise. This configuration is unique to the bench of this invention.

Figure 5B:
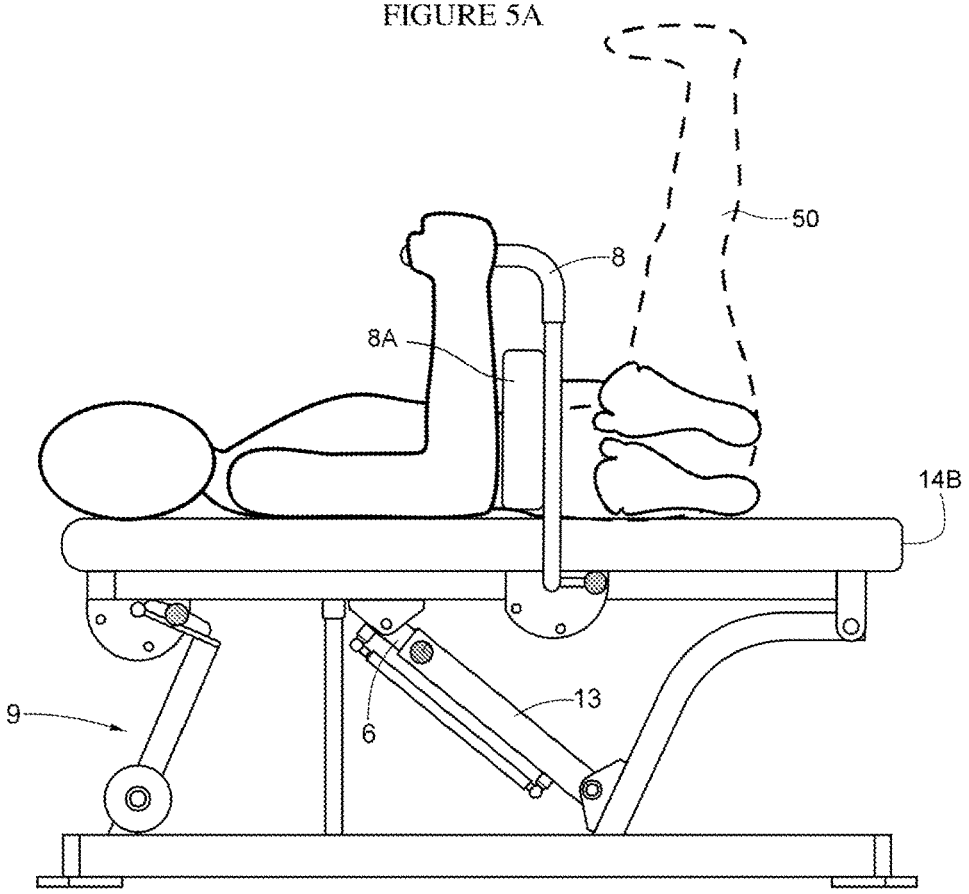
FIG. 5B. A side view of a user using the exercise device of this disclosure to perform a lower-body rotation.

FIG. 5B is a side view of a user 50 performing a lower-body rotation exercise that trains the core muscles groups such as external oblique. As shown in FIG. 5B, the hand grips 8 are adjusted to the extended position so that the user 50 can hold them to steady the upper torso. Elbow pad 8A allows for more comfortable exercise, especially when the bench 14 is adjusted to inclined toward the foot end 14B. Such functionality is not available on regular benches where no hand grips are provided for stabilizing the user's upper body.

Figure 5C:
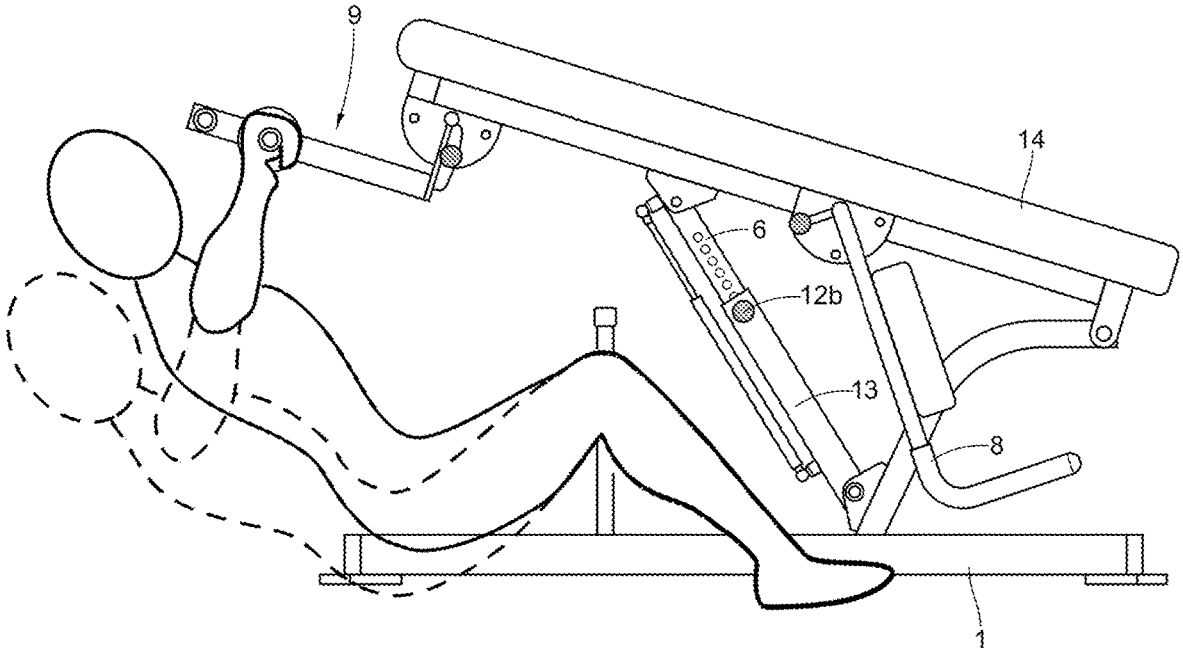
FIG. 5C. A side view of a user using the exercise device of this disclosure to perform an assisted pull-up.

FIG. 5C is a side view of a user 50 performing a pull-up exercise that trains the muscles groups such as biceps and teres major. In this configuration the user 50 grabs to the handle 9A of the foot grip module 9 while sitting on the ground. The bench 14 can also be adjusted in accordance with the user's body length/height by adjusting the telescoping assembly 6 and/or the angle of the foot grip module 6. As with other gravity-assisted exercises, the fewer points of contact to the ground, the more force is required to complete the exercise. Therefore, with the bench 14 adjusted further from the ground, user 50 can also increase the difficulty of this exercise.

Figure 5D:
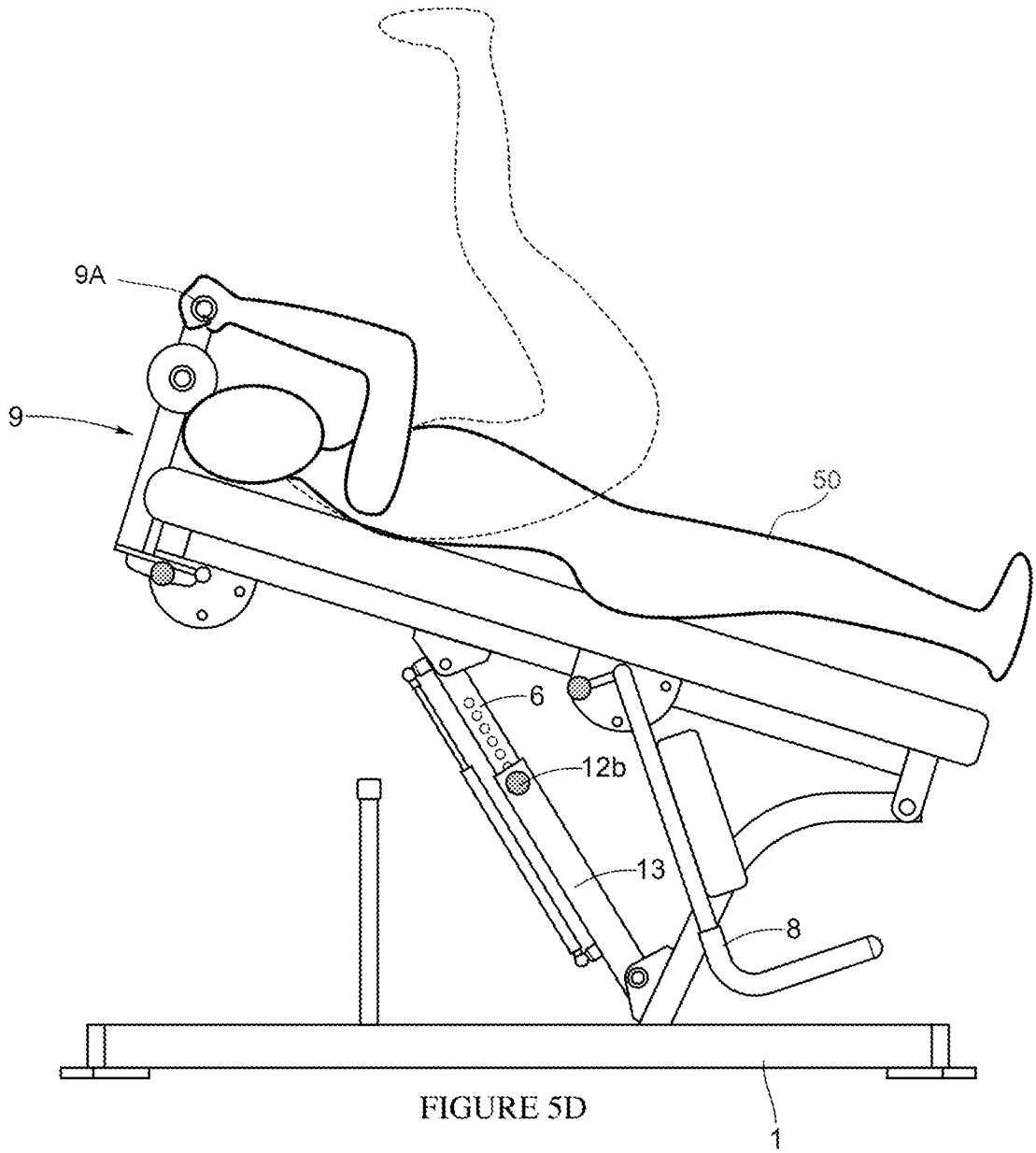
FIG. 5D. A side view of a user using the exercise device of this disclosure to perform a body curl exercise.

FIG. 5D is a side view of a user 50 performing a body curl on the exercise device of this disclosure. The bench 14 is inclined to give the user 50 desired gravitational loading. The foot-grip module 9 is rotated to the upright position The user 50 holds the handle 9A of the foot grip module 9 with both hands, and then lift the lower body up as high as possible toward the upper body, thus trains the rectus abdominis. Such functionality is a feature of the present invention and can be safely performed.

Figure 5E:
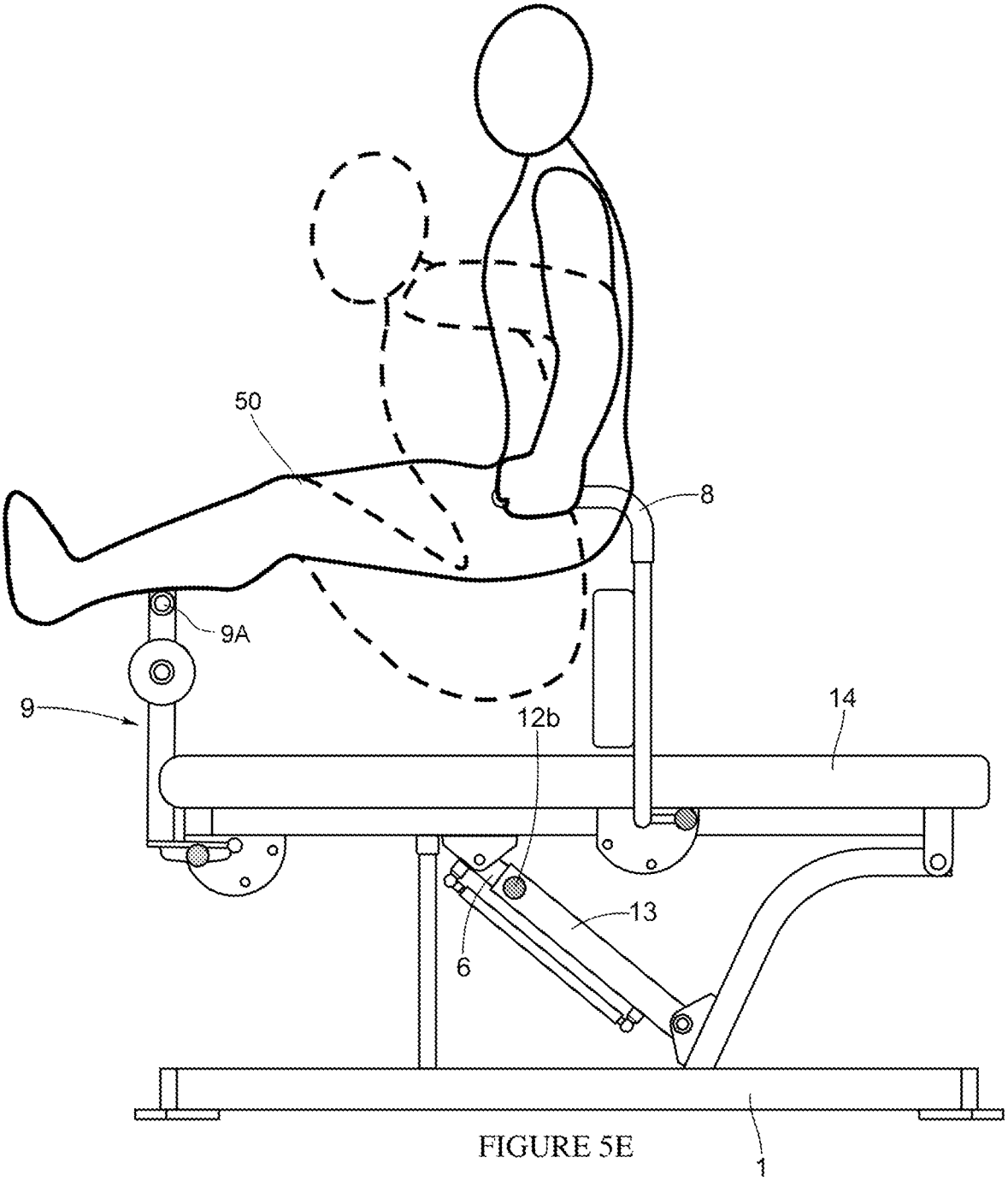
FIG. 5E. A side view of a user using the exercise device of this disclosure to perform a body dip exercise.

FIG. 5E is a side view of a user 50 performing a body dip on the exercise device of this disclosure. The bench 14 is kept at level, and both the foot grip module 9 and the hand grip 8 are rotated to the upright position. The user 50 holds the hand grips 8 while laying both legs on top of the handle 9A. By lowering and raising the body weight, the user 50 is able to train the chest, triceps and front shoulders. Such functionality is a feature of the present invention.

Figure 5F:
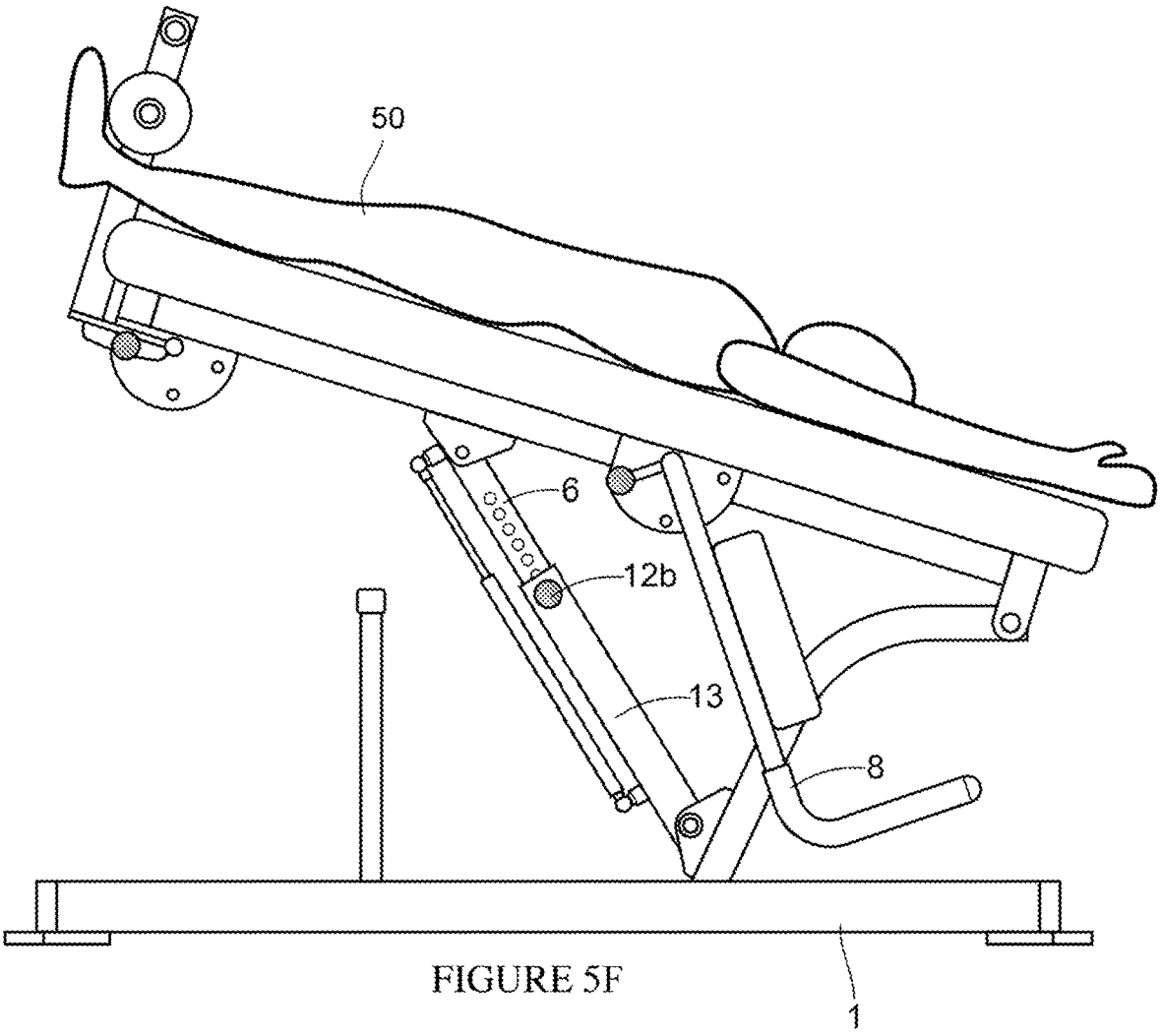
FIG. 5F. A side view of a user using the exercise device of this disclosure in an inversion position.

FIG. 5F is a side view of a user performing an inversion exercise. An inversion exercise is beneficial for a user for both increasing blood circulation and increased gravity training. As shown in FIG. 4, the foot grip module 9 is adjusted to the upright position, allowing the user 50 to engage his feet 41 with the foot grip module 9, preventing the user from sliding off the bench 14. As discussed earlier, the inclination of the bench 14 is adjustable by extending or retracting the adjustable arm 13 connecting the bench 14 to the base frame 1. In the most inclined position as shown in FIG. 4, the adjustable arm 13 is extended to the fullest extent so as to provide user the required gravity force. Such functionality is a feature of this invention.

It is to be noted that during inversion, a user is more easily to be injured if the bench is not fixated, for example if the angle-adjusting mechanism is not stable, collapsed bench may cause serious injury to the user's head, neck and spine. Therefore, inventor provided triple safety mechanism to prevent such injury. First of all, the locking-pull pin 12B on the telescoping assembly 6 maintains the adjustable arm at the desired length. Secondly, the pneumatic dashpot 7 provides additional cushion in the rare event that the locking-pull pin of the telescoping assembly fails due to either human error or mechanical issue. Lastly, the safety rod 5 ensures that the bench will not completely collapse to the ground. User can therefore confidently adjust the multifunctional exercise device to his/her liking and perform exercises.

Figure 5G:
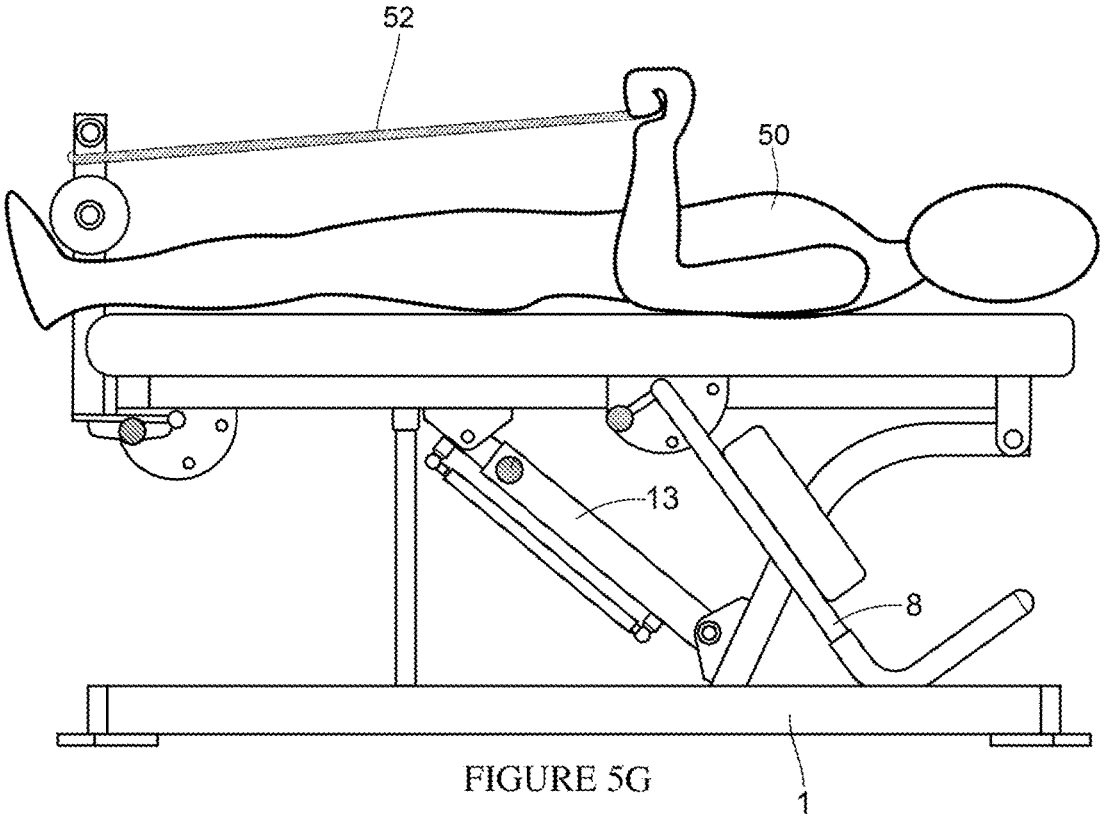
FIG. 5G. A side view of a user using the exercise device of this disclosure along with resistant ropes to perform resistive training.

FIG. 5G is a side view showing the user training different part of her muscles on the bench, with the assistance of elastic ropes 52. In this configuration, the bench is kept at level, and the foot grip module 9 is adjusted to the upright position and serves as holding post for the elastic ropes. As the inclination of the bench being adjusted, user can also adjust the desirable resistive loading level for the exercise. Such functionality is a feature of this invention.

Figure 5H:
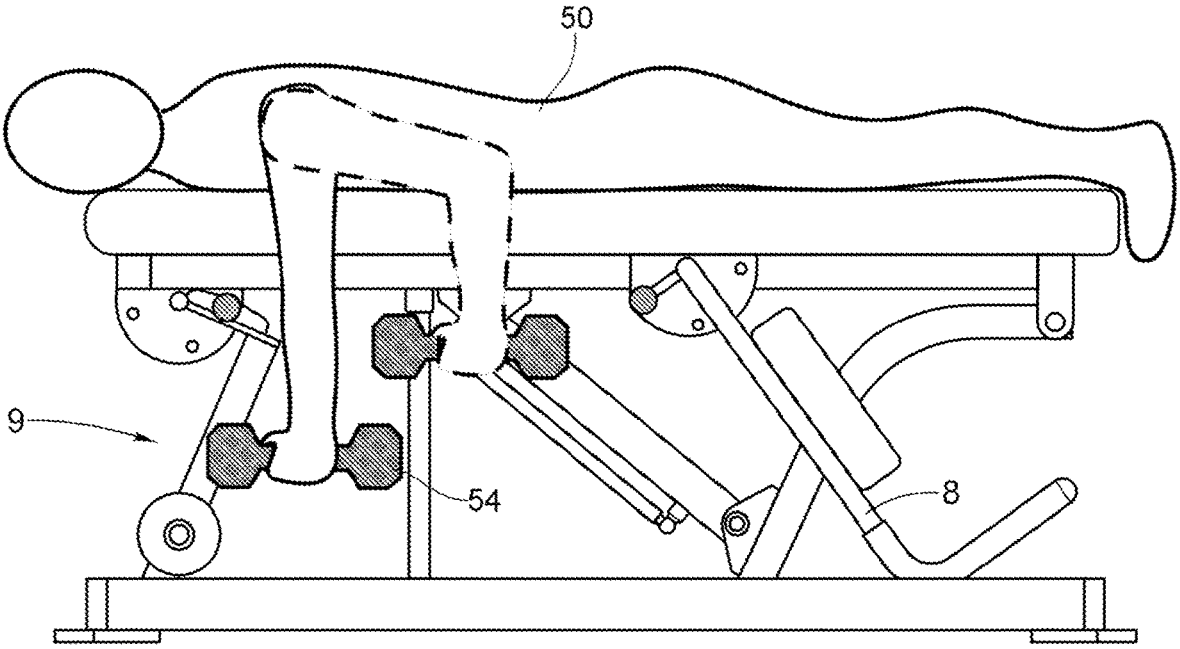
FIG. 5H. A side view of a user using the exercise device of this disclosure to perform a dumbbell raise.

FIG. 5H is a side view showing the user using the exercise device of this disclosure to perform dumbbell raise to train shoulder and back. As discussed above, the bench pad of this disclosure has cutouts (see 141 in FIGS. 2-3) that allows a user to utilize the space beneath the bench pad. A conventional bench does not without such cutouts would be much more difficult for the user to perform the same dumbbell raise.

Further, the exercise device of this disclosure is specifically designed at a clearance to allow a user's arms to fully stretch during dumbbell raise exercises. Without sufficient clearance, users cannot have a full cycle to maximize the training efficiency. Therefore, the height of the bench in combination with the cutouts allows users to more easily perform dumbbell raises on the exercise device that would not be possible on conventional benches.

From the discussion above, a multi-functional exercise device with small footprint is disclosed, with which a user can perform a great number of exercises that cannot otherwise be possible without this device, while requiring only one single exercise device, saving both cost and space in the process. The multi-functional exercise device is also easy to change to different configurations and safe to use.

The following reference numbers are used:

| Number | Part | Number | Part |
|---|---|---|---|
| 1 | Base frame | 2 | Leg |
| 2A | Foot pad | 3 | Steel rod |
| 4 | Band peg | 5 | Safety rod |
| 6 | Telescoping assembly | 6A | End of smaller tube |
| 7 | Dashpot | 8 | Hand Grip |
| 8A | Elbow pad | 9 | Adjustable foot grip module |
| 9A | Handle | 9B | Foot pad |
| 10 | Bench frame | 10A | Openings |
| 10B | Joint point | 11 | Curved support |
| 12 | Snap-back locking pull pin | 12A | Snap-back locking pull pin |
| 12B | Snap-back locking pull pin | 13 | Adjustable arm |
| 14 | Bench pad | 14A | Head end |
| 14B | Foot end | 141 | Cutout |
| 15 | Adjustment plate | 16 | Adaptor plate |
| 16A | Holes | 16B | Holes |
| 21 | Cross member | 22 | Cross member |
| 23 | Base point | 24 | Bolt |
| 25 | Bolt | | |

What is claimed is:

1. A multi-functional exercise device, comprising:

a) a base frame having a plurality of legs extending horizontally along a longitudinal axis, a curved support extending upwardly from the base frame, and an adjustable arm with a telescoping means extending upward from a middle of the base frame;

b) a bench frame having a head end and a foot end, wherein the curved support connects to the foot end and the adjustable arm pivotally connects to a middle of the bench frame adjustably whereby the telescoping means adjusts an angle of an upper bench from horizontal to about 30 degrees above horizontal;

c) a bench pad overlaying the bench frame;

d) hand grips pivotally connected to either side of the middle of the bench frame, wherein the hand grips have a plurality of configurations relative to the bench frame movable and secured by a switching mechanism, wherein in one of said plurality of configurations the hand grips are above the bench frame, and in one other said configurations the hand grips are below the bench frame;

e) an elbow pad overlaying each said hand grip spaced below a grip for hands of a user to contact the user's elbows; and f) a detachable foot grip module pivotally connected to the head end of the bench frame, the foot grip module switchable between a plurality of angles and locked by a switching mechanism.

2. The multi-functional exercise device of claim 1, wherein each of the plurality of legs has at least one band peg.

3. The multi-functional exercise device of claim 1, wherein a resistive rope is capable of being placed around the at least one band peg on each of the plurality of legs to perform resistive training.

4. The multi-functional exercise device of claim 1, wherein an end of each of the plurality of legs of the base frame has a foot pad contacting a floor surface.

5. The multi-functional exercise device of claim 1, wherein the telescoping means comprising a smaller tube inside a larger tube, the smaller tube having a plurality of through holes spaced along its length, and wherein an overall length of the telescoping means is adjusted and maintained through a lock pin located on the larger tube that engages one of said plurality of through holes on the smaller tube.

6. The multi-functional exercise device of claim 1, further comprising a hydraulic dashpot alongside the telescoping means.

7. The multifunctional exercise device of claim 1, wherein each of the hand grips is pivotally connected to an adaptor plate under the middle of the bench frame, the adaptor plate having a plurality of through holes, and each of the hand grips further comprising a snap-back locking pin corresponding to one of the plurality of through holes on the adaptor plate to lock the hand grips at one of the plurality of configurations.

8. The multi-functional exercise device of claim 1, wherein each of said hand grips is configured to rotate along the horizontal plane so that the user's head is configured to rest on either the head end or the foot end of the upper frame while holding the hand grips.

9. The multi-functional exercise device of claim 1, a resistive rope is capable of being placed around the foot grip module, when the foot grip module is rotated to an upright configuration, to perform resistive training.

10. The multi-functional exercise device of claim 1, wherein the base further comprising a safety rod extending vertically to prevent the head end of the upper frame from lowering below the foot end thereof.

11. The multi-functional exercise device of claim 1, wherein the foot grip module is pivotally connected to an adjustment plate under the head end of the bench frame, the adjustment plate having a plurality of through holes, and the foot grip module further comprising a snap-back locking pin corresponding to one of the plurality of through holes on the adjustment plate to lock the foot grip module at one of the plurality of configurations.

* * * * *